US009755348B2

(12) United States Patent
Guo et al.

(10) Patent No.: US 9,755,348 B2
(45) Date of Patent: Sep. 5, 2017

(54) WATERPROOF ELECTRICAL CONNECTOR ASSEMBLY

(71) Applicant: FOXCONN INTERCONNECT TECHNOLOGY LIMITED, Grand Cayman (KY)

(72) Inventors: Jing-Jie Guo, HuaiAn (CN); Jun Zhao, HuaiAn (CN); Cai-Yun Zhang, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/406,670

(22) Filed: Jan. 14, 2017

(65) Prior Publication Data

US 2017/0207565 A1 Jul. 20, 2017

(30) Foreign Application Priority Data

Jan. 14, 2016 (CN) ..... 2016 1 0022836

(51) Int. Cl.

| | |
|---|---|
| ***H01R 13/73*** | (2006.01) |
| ***H01R 13/504*** | (2006.01) |
| ***H01R 13/658*** | (2011.01) |
| ***H01R 13/405*** | (2006.01) |
| ***H01R 12/71*** | (2011.01) |
| *H01R 12/72* | (2011.01) |
| *H01R 12/50* | (2011.01) |
| *H01R 13/74* | (2006.01) |
| *H01R 13/6593* | (2011.01) |
| *H01R 13/6587* | (2011.01) |

(52) U.S. Cl.

CPC ..... *H01R 13/504* (2013.01); *H01R 12/716* (2013.01); *H01R 13/405* (2013.01); *H01R 13/658* (2013.01); *H01R 12/722* (2013.01); *H01R 13/6587* (2013.01); *H01R 13/6593* (2013.01); *H01R 13/748* (2013.01); *H01R 23/7073* (2013.01)

(58) Field of Classification Search

CPC ..... H01R 13/6593; H01R 13/6587; H01R 23/7073; H01R 13/748; H01R 12/722

See application file for complete search history.

(56) References Cited

U.S. PATENT DOCUMENTS 6,280,202 B1 * 8/2001 Alden, 3rd ..... H05K 7/142 174/137 D
6,955,544 B2 * 10/2005 Miquel ..... H05K 7/142 361/752

(Continued)

FOREIGN PATENT DOCUMENTS

CN 203859282 10/2014

*Primary Examiner* — Tho D Ta
(74) *Attorney, Agent, or Firm* — Wei Te Chung; Ming Chieh Chang

(57) ABSTRACT

An electrical connector includes: a terminal module including an upper and lower module parts; a metallic plate positioned between the upper and lower module parts; an insulative base insert molding the upper and lower module parts with the metallic plate; a shielding shell enclosing the upper and lower module parts; and a fastener extending through the upper module part, the metallic plate, and the lower module part and beyond a bottom of the lower module part for mounting to a printed circuit board.

18 Claims, 11 Drawing Sheets

(56) References Cited

U.S. PATENT DOCUMENTS

| | | | | |
|---|---|---|---|---|
| 7,651,345 | B2 * | 1/2010 | Tomioka | H01Q 1/2258 439/573 |
| 9,564,716 | B2 * | 2/2017 | Kao | H01R 13/6586 |
| 2001/0039143 | A1 * | 11/2001 | Ikeda | H05K 9/006 439/573 |
| 2013/0084737 | A1 * | 4/2013 | Cai | H01R 13/447 439/573 |
| 2016/0111821 | A1 | 4/2016 | Lan et al. | |
| 2017/0110818 | A1 * | 4/2017 | Guo | H01R 12/716 |

* cited by examiner

WATERPROOF ELECTRICAL CONNECTOR ASSEMBLY

BACKGROUND OF THE INVENTION

1. Field of the Invention

The present invention relates to an electrical connector having an upper and lower module parts and an intermediate metallic plate that are firmly fastened together.

2. Description of Related Arts

China Patent No. 203859282, issued on Oct. 1, 2014, discloses an electrical connector including an upper and lower terminal modules and a metallic plate positioned between the upper and lower terminal modules. The upper and lower terminal modules are engaged to each other through an engaged post and hole structure. The lower terminal module further has posts for mounting to a printed circuit board.

SUMMARY OF THE INVENTION

An electrical connector comprises: a terminal module including an upper and lower module parts; a metallic plate positioned between the upper and lower module parts; an insulative base insert molding the upper and lower module parts with the metallic plate; a shielding shell enclosing the upper and lower module parts; and a fastener extending through the upper module part, the metallic plate, and the lower module part and beyond a bottom of the lower module part for mounting to a printed circuit board. The fastener properly positions the upper module part, the metallic plate, and the lower module part.

DETAILED DESCRIPTION OF THE PREFERRED EMBODIMENT

Figure 1:
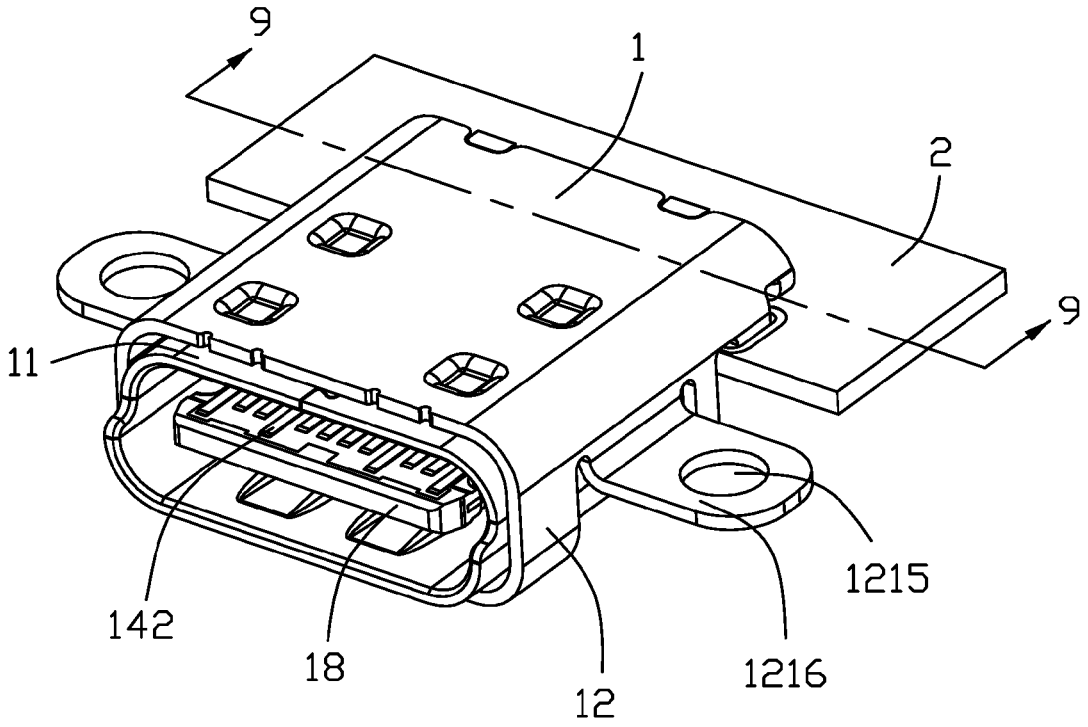
FIG. 1 is a perspective view of an electrical connector in accordance with the present invention mounted to a printed circuit board.
Figure 2:
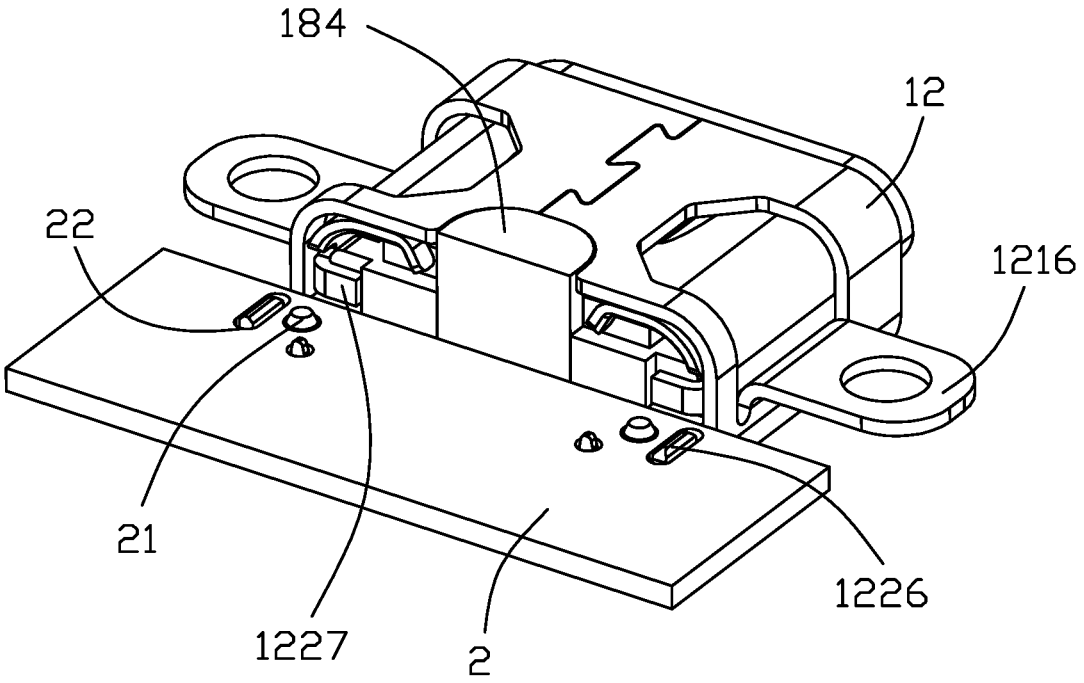
FIG. 2 is another perspective view of the electrical connector mounted to the printed circuit board.
Figure 3:
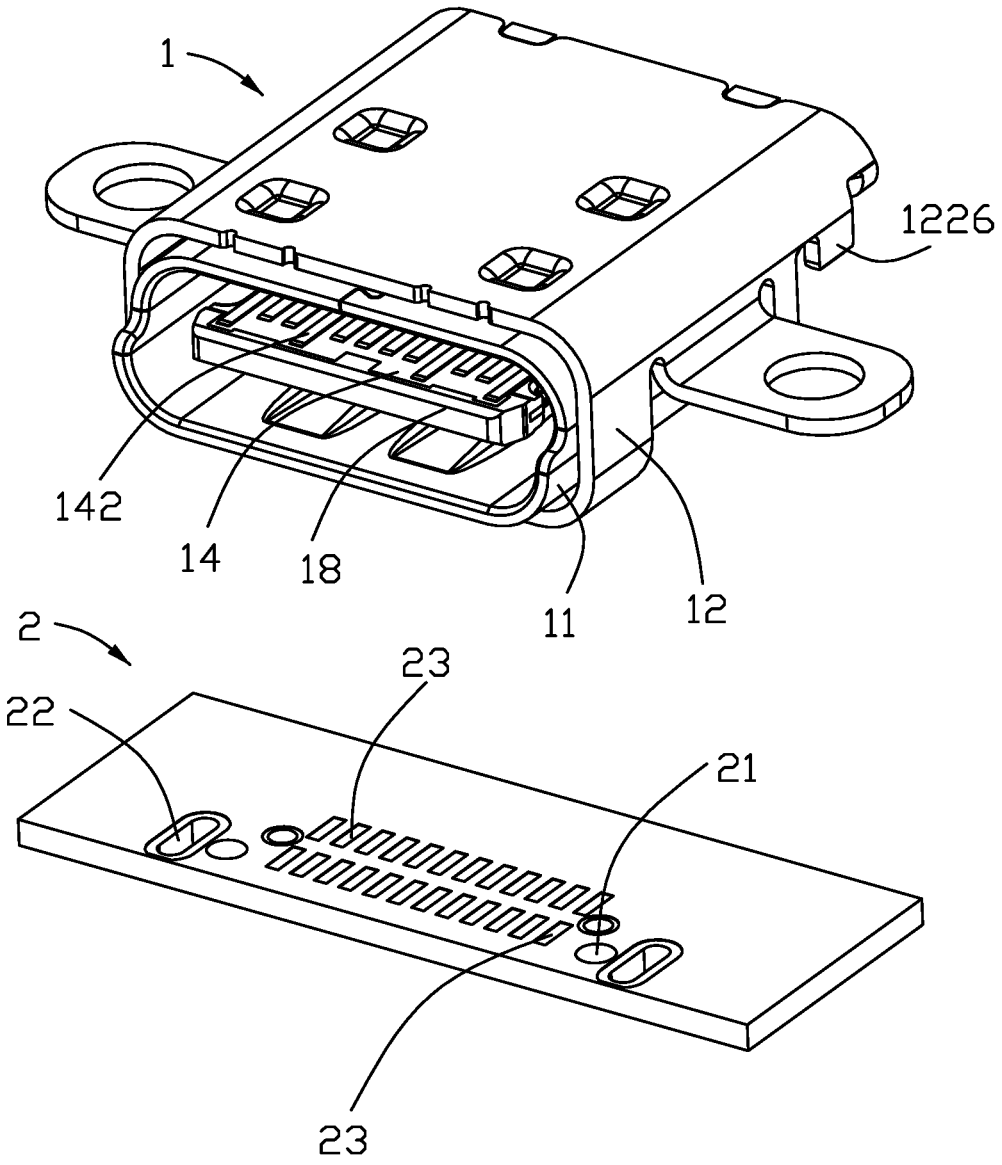
FIG. 3 is an exploded view of FIG. 1.
Figure 4:
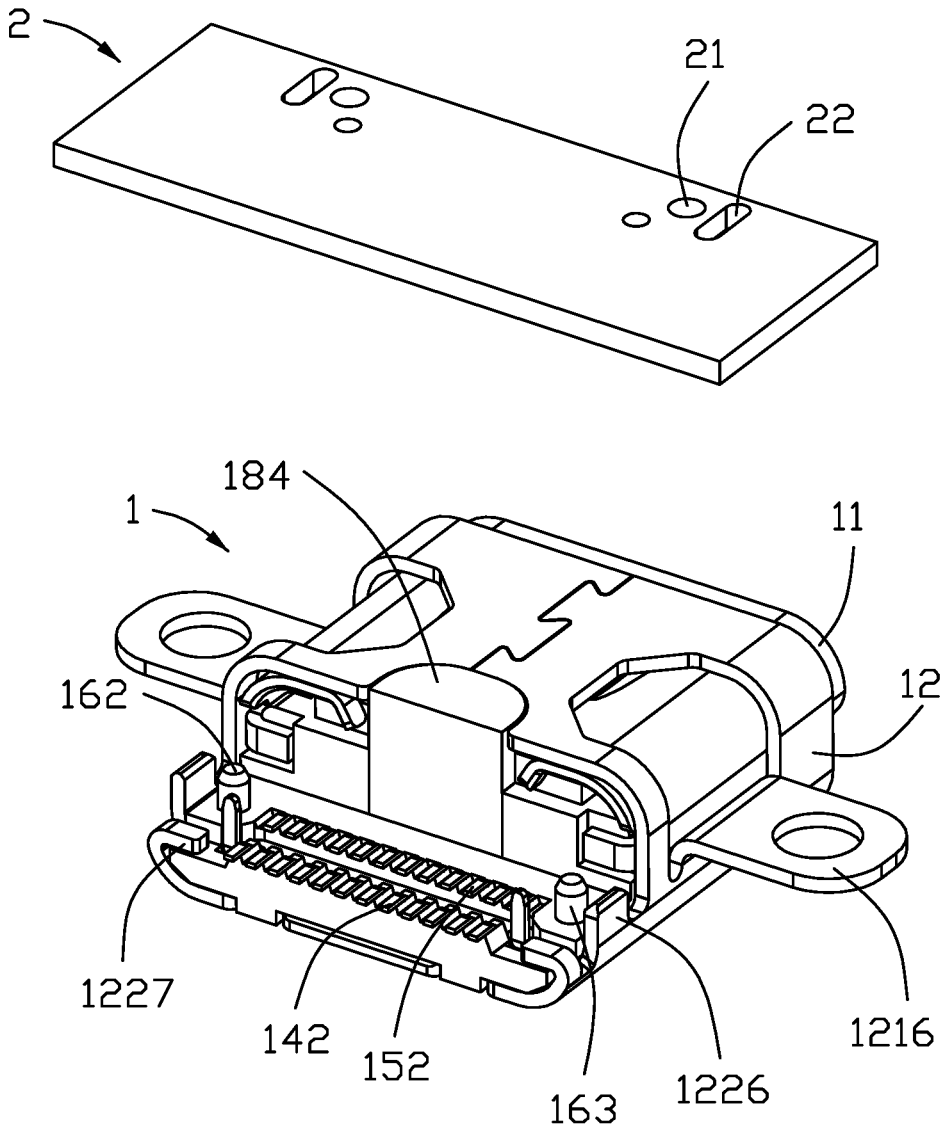
FIG. 4 is an exploded view of FIG. 2.

Referring to FIGS. 1 to 11, an electrical connector 1 to be mounted on a printed circuit board (PCB) 2 comprises: a terminal module 13 including an upper and lower module parts 14 and 15; a metallic plate 19 positioned between the upper and lower module parts; an insulative base 18 insert molding the upper and lower module parts with the metallic plate; a shielding shell 17 enclosing the upper and lower module parts; and a fastener 16 extending through the upper module part 14, the metallic plate 19, and the lower module part 15 and beyond a bottom of the lower module part 15 for mounting to the PCB 2.

Figure 5:
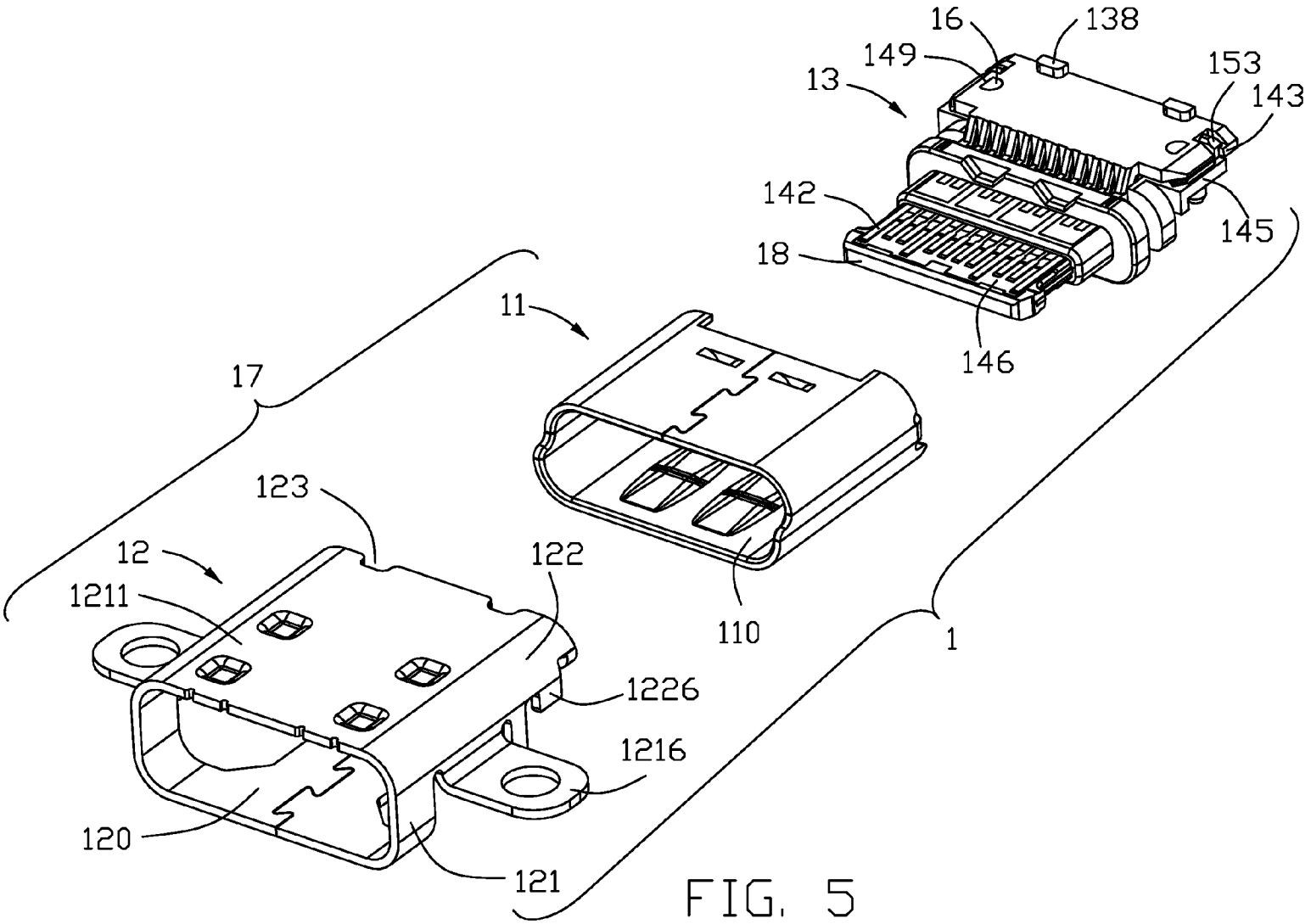
FIG. 5 is a perspective view of the electrical connector.
Figure 6:
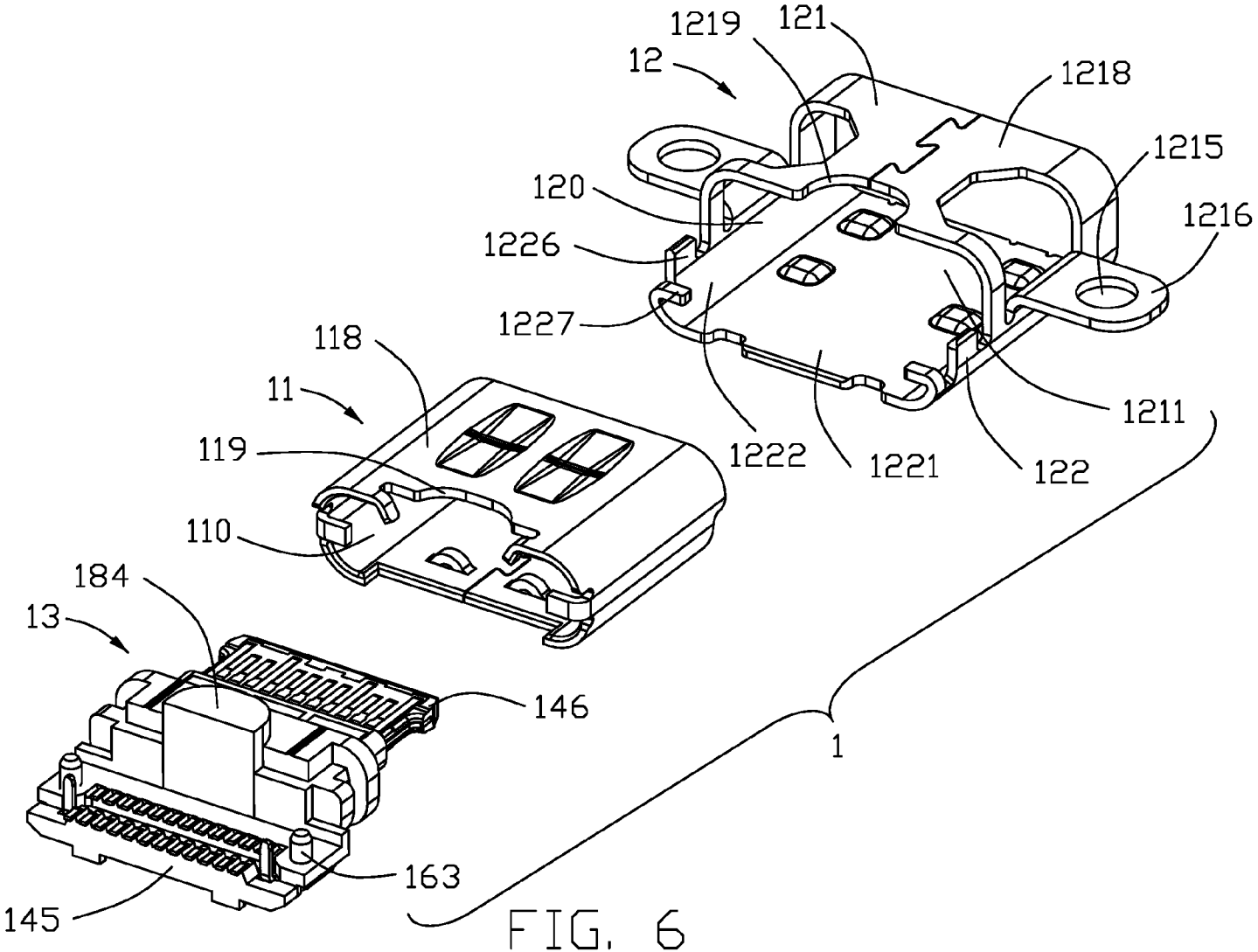
FIG. 6 is another perspective view of the electrical connector.

As shown in FIGS. 5-8, the upper module part 14 includes an insulative body 141 and a plurality of terminals 142, and the lower module part 15 includes an insulative body 151 and a plurality of terminals 152. Each of the insulative bodies 141 and 151 includes a body portion 145, a tongue 146, and a connection portion 148 between the body portion 145 and the tongue 146. The body portion 145 of the upper insulative body 141 has a groove 143. The body portion 145 of the lower insulative body 151 has a latch 153 locked to the groove 143. The tongue 146 of the upper insulative body 141 has a slot 144. The tongue 146 of the lower insulative body 151 has a latch 154 locked to the slot 144. The tongues 146 of the upper and lower insulative bodies 141 and 151 are provided with one or more positioning holes 147 and/or posts 157. Similar to the upper and lower insulative bodies 141 and 151, the metallic plate 19 includes a body portion 195, a tongue 196, and a connection portion 198 between the body portion 195 and the tongue 196. The body portions 145 of the upper and lower insulative bodies 141 and 151 and the body portion 195 of the metallic plate 19 are provided with respective holes accommodating the fastener 16. Specifically, in the embodiment shown, there are two fasteners 16. Corresponding to each of the two fasteners 16, the upper insulative body 141 has a first/upper hole 149, the metallic plate 19 has a second/middle hole 199, and the lower insulative body 151 has a third/lower hole 159. Moreover, since the fastener 16 is formed by insert molding, the first hole 149 may be made offset from the second hole 199, and the second hole 199 may be made offset from the third hole 159. Notably, in this embodiment, the first hole 149 includes a full round upper part and a cutoff lower part The insulative base 18 is insert molded with generally a front part of the upper and lower module parts 14, 15 and the metallic plate 19 and includes a rear part 181 molding with a front of the connection portions 148 and 198 and a front part 182 molding with the tongues 146 and 196. The insulative base 18 further includes a limiting block 184 extending downwardly from a bottom surface 183 thereof. The shielding shell 17 includes a bottom wall accommodating the limiting block 184. The block 184 has a platform 185 and a positioning wall 186. The connection portion 148 of the lower insulative body 151 has a notch 1480 (FIG. 8) for accommodating the positioning wall 186. The connection portion 148 of the lower insulative body 151 further has a recess 1580 (FIG. 7) for receiving the connection portion 148 of the upper insulative body 141. The body portion 145 of the upper insulative body 141 has a pair of protrusions 138 (FIG. 5).

Figure 7:
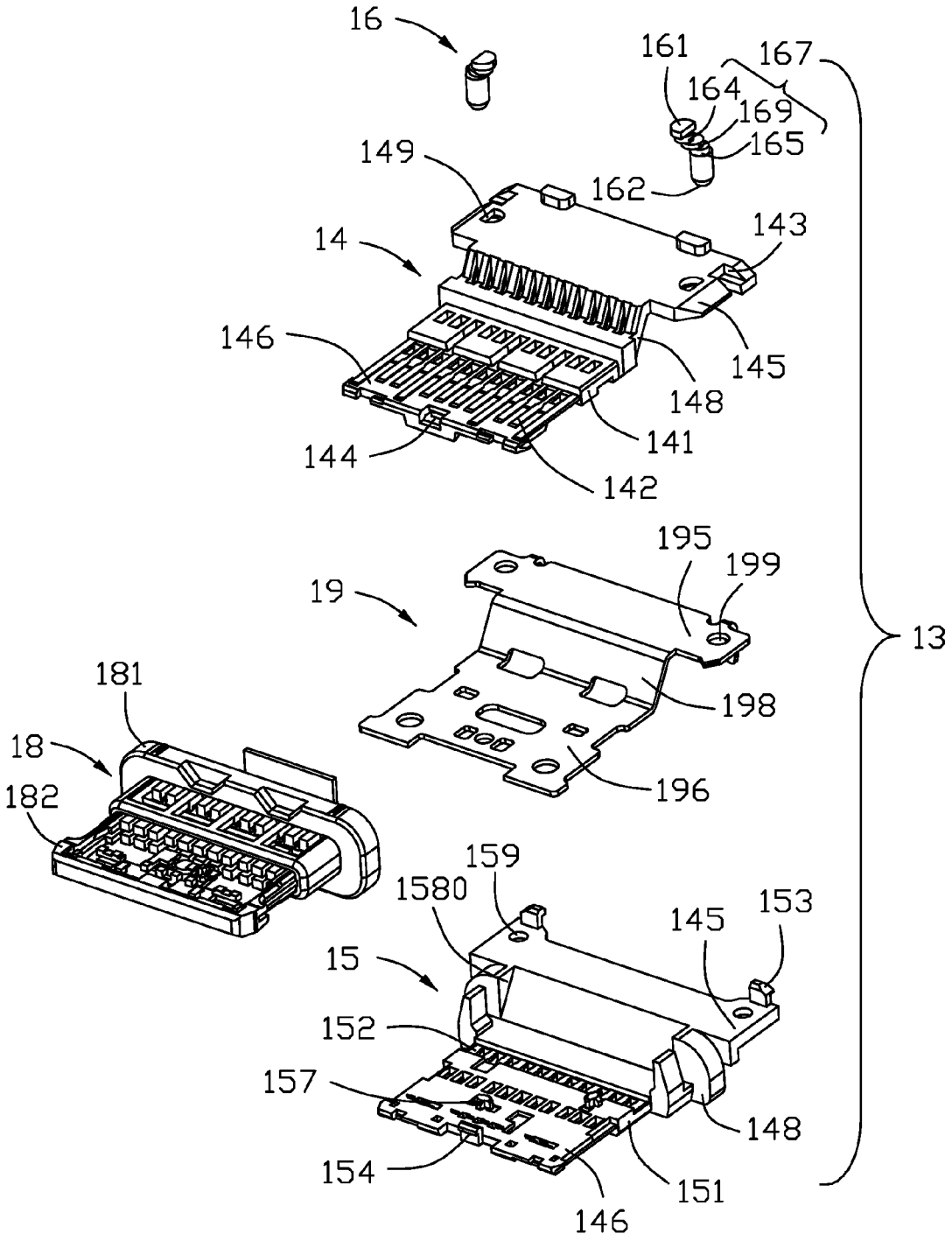
FIG. 7 is a perspective view of the electrical connector, omitting a shielding shell thereof.
Figure 8:
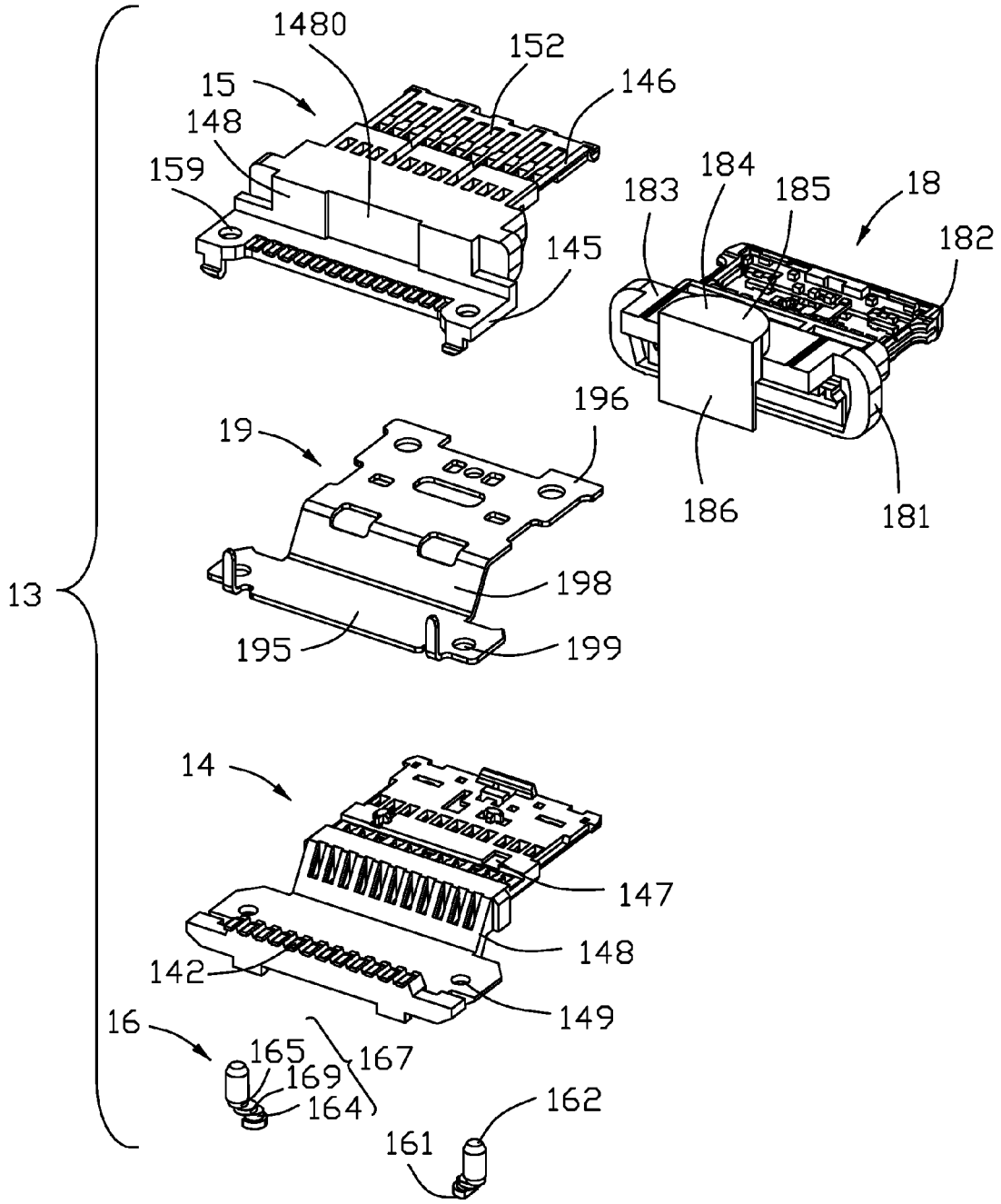
FIG. 8 is a view similar to FIG. 7 but from a different perspective.
Figure 9:
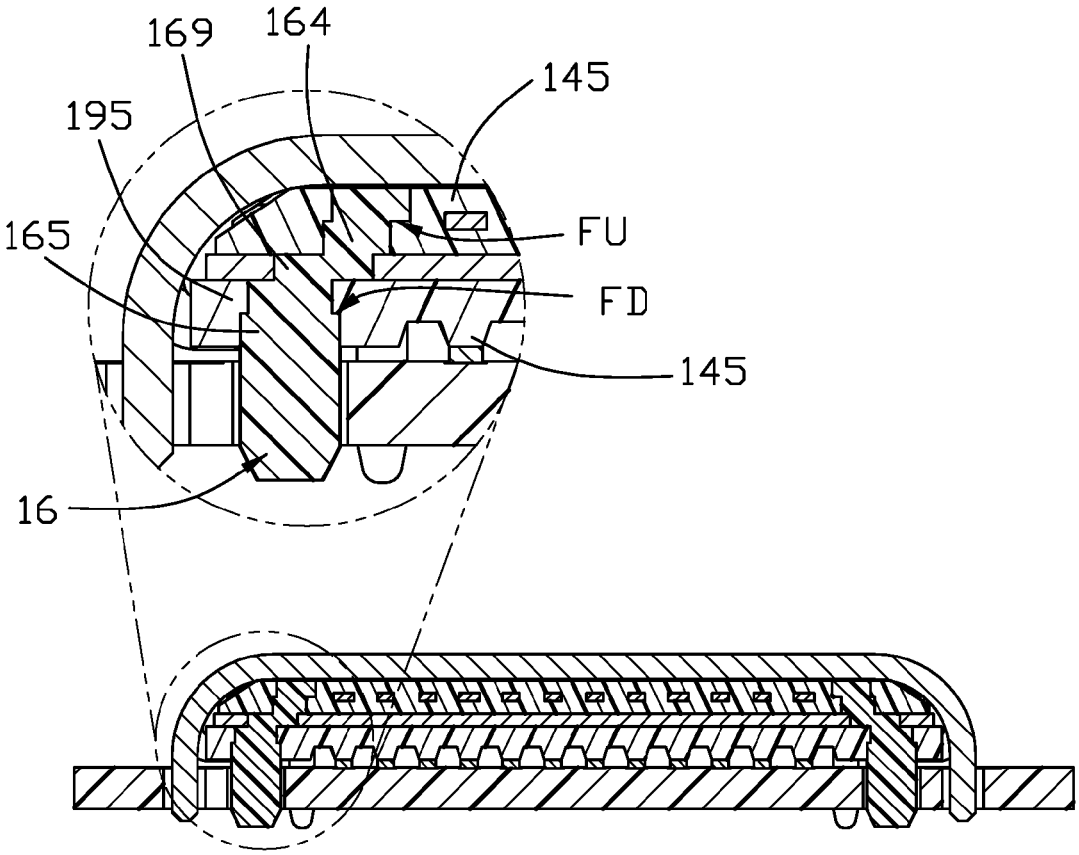
FIG. 9 is a cross-sectional view of the electrical connector in FIG. 6 to show how the fastener extends through the corresponding first hole, second hole and third hole, thus resulting in a non-straight structure for interengaging the corresponding upper module part, lower module part and metallic plate therebetween in the vertical direction.

As shown in FIGS. 7 and 8 as a separate element for clarity, the fastener 16 includes a fixing portion 167, a mounting portion 163 (FIG. 4 or FIG. 6) extending downwardly from the fixing portion beyond a bottom of the lower module part 15 for mounting to the PCB 2, an upper face 161, and a lower face 162. The fixing portion 167 includes non-concentric, stacked first block 164, second block 169, and third block 165. The first block 164 has an upper wider part and a lower narrower part. The third block 165 is narrower than the mounting portion 163.

The shielding shell 17 is metallic and includes an inner shell 11 and an outer shell 12. The inner shell 11 has a receiving cavity 110 and the outer shell 12 has a receiving cavity 120. The outer shell 12 includes a sleeve 121 having an upper wall 1211 and a rear mount 122. The sleeve 121 has a pair of wings 1216 with holes 1215. The mount 122 is generally U-shaped and has a top wall 1221 continuing the upper wall 1211 and a pair of side walls 1222. Each side wall 1222 has a mounting arm 1226 and a limiting arm 1227. The top wall 1221 has two rear notches 123 for accommodating the protrusions 138. The inner shell 11 and the outer shell 12 have bottom walls 1218 and 118 with limiting notches 1219 and 119, respectively, for accommodating the limiting block 184.

The PCB 2 has a pair of holes 21 receiving the mounting portion 163 of the fastener 16, a pair of holes 22 receiving the mounting arms 1226, and two rows of conductive pads 23.

Figure 10:
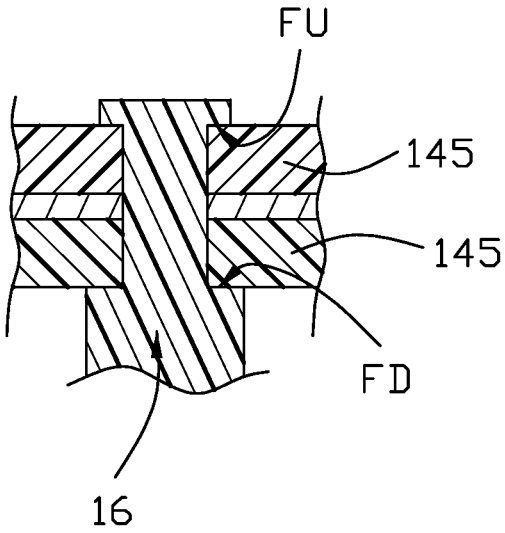
FIG. 10 is a partial cross-sectional view of the terminal module of the electrical connector according to another embodiment of the invention wherein a common center axis of the whole fastener vertically extends in a straight manner.
Figure 11:
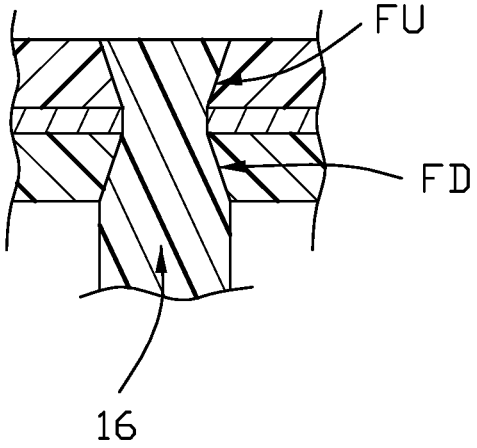
FIG. 11 is another partial cross-sectional view of the terminal module of the electrical connector according to another embodiment of the invention wherein a common center axis of the whole fastener vertically extends in a straight manner.

In the present invention, the fastener 16 is formed during molding the insulative base 18. The wider parts at the two ends of the fastener 16 firmly position the upper module part 14, the metallic plate 19, and the lower module part 15. Understandably, the feature of the invention is to provide a non-straight hole to receive the corresponding fastener by molding the fastener within the non-straight or non-vertical hole so as to provide retention not only for the fastener to the terminal module but also retention among the stacked components of the terminal module, i.e., the upper module part 14, the metallic plate 19 and the lower module part 14, which are stacked with one another in the vertical direction. In addition, the fastener 16 itself provides the mounting function for mounting the whole connector upon the printed circuit board. As mentioned before, in this embodiment the center axis of the first hole 149, those of the second hole 199 and the third hole 159 are not in a the same vertical line but being offset from each other. The key issue is that the first hole 149 is equipped with an upward surface FU for being downwardly pressed by the first block 164, and the third hole 159 is equipped with a downward surface FD for being upwardly abutting against the third block 165. In this embodiment, both the surfaces FU and FD extend horizontally. In other words, there is a step structure in each of the first hole 149 and the third hole 159. Alternately, without forming the step structure in each of the first hole 149 and the third hole 159, the fastener 16 may be equipped with a relatively large head directly downwardly pressing an upper surface of the upper module part 14, and a relatively larger bottom directly upwardly abutting against an undersurface of the lower module part 15 as shown in FIG. 10. By following the similar concept, in FIG. 11 in an alternate embodiment, those holes may share the common center axis of all the three holes along the vertical direction as long as the first hole has a larger diameter on an outer/upper part and a smaller diameter on an inner/lower part, and the third hole has a larger diameter on an outer/lower part and a smaller diameter on an inner/upper part so as to form a structure like the dumbbell or hourglass configuration which also provide the corresponding upward and downward surfaces FU, FD thereof in an oblique manner. It is also noted that in the first embodiment of the fastener 16, a length of an upper segment embedded within upper module part 14 and the lower module part 15, is somewhat larger than that of a lower segment exposed under the lower module part 15, thus assuring the required strength thereof during use.

What is claimed is:

1. An electrical connector comprising:
a terminal module including:
an upper and lower module parts;
a metallic plate positioned between the upper and lower module parts;
an insulative base insert molding the upper and lower module parts with the metallic plate;
a shielding shell enclosing the upper and lower module parts; and
a fastener extending through the upper module part, the metallic plate, and the lower module part and beyond a bottom of the lower module part for mounting to a printed circuit board;
wherein the fastener extends through a first hole of the upper module part, a second hole of the metallic plate, and a third hole of the lower module part, the first hole being offset from the second hole, the second hole being offset from the third hole.

2. The electrical connector as claimed in claim 1, wherein the insulative base includes a bottom limiting block and the shielding shell includes a bottom wall accommodating the limiting block.

3. The electrical connector as claimed in claim 1, wherein the insulative base includes a positioning wall and the lower module part includes a notch accommodating the positioning wall.

4. An electrical connector comprising:
a terminal module including: an upper and lower module parts;
a metallic plate positioned between the upper and lower module parts; a fastener extending through the upper module part, the metallic plate, and the lower module part and beyond an undersurface of the lower module part with a distance for mounting to a printed circuit board in a vertical direction; and a metallic shielding shell enclosing the terminal module; wherein said fastener includes means for securing all the upper module part, the lower module part and the metallic plate therebetween together in said vertical direction;
wherein said means includes an upper hole in the upper module part having an upward surface to be downwardly pressed by the fastener, and a lower hole in the lower module part having a downward surface to be upwardly pressed by the fastener.

5. The electrical connector as claimed in claim 4, wherein said upward surface and said downward surface extend either horizontally or obliquely.

6. The electrical connector as claimed in claim 4, wherein the upper hole has a larger upper section and a smaller lower section while the lower hole has a larger lower section and a smaller upper section.

7. The electrical connector as claimed in claim 4, wherein both the upper hole and the lower hole are concentrically arranged with each other in the vertical direction.

8. The electrical connector as claimed in claim 4, wherein a centerline of said upper hole and that of the lower hole are transversely offset from each other.

9. The electrical connector as claimed in claim 4, wherein at least one of said upper hole and said lower hole forms a step structure therein.

10. The electrical connector as claimed in claim 4, wherein said fastener is insulative and formed via an injection molding process.

11. The electrical connector as claimed in claim 4, wherein said fastener has a relatively large head downwardly pressing an upper surface of the upper module part, and a relatively large bottom upwardly abutting against said undersurface of the lower module part.

12. The electrical connector as claimed in claim 4, wherein said terminal module further includes an insulative base overmolded upon all the upper module part, the lower module part and the metallic plate to fasten all the upper module part, the lower module part and the metallic plate together.

13. The electrical connector as claimed in claim 12, wherein the insulative base forms a limiting block forwardly abutting against a rearward edge of the shielding shell so as to prevent an excessive forward movement of the terminal module with regard to the shielding shell.

14. An electrical connector comprising:

a terminal module including:

an upper and lower module parts;

a metallic plate positioned between the upper and lower module parts;

a fastener extending through the upper module part, the metallic plate, and the lower module part and beyond an undersurface of the lower module part with a distance for mounting to a printed circuit board in a vertical direction; and a metallic shielding shell enclosing the terminal module; wherein the fastener is made via an insert-molding process with insulative material thereof, and includes a relatively large head downwardly pressing an upward surface on the upper module part, and a relatively large bottom upwardly abutting against a downward surface on the lower module part so as to not only fasten said upper module part, said lower module part and said metallic plate together as one combination in the vertical direction without a risk of disassembling, but also secure the fastener to said combination of said upper module part, said lower module part and said metallic plate without a risk of withdrawal.

15. The electrical connector as claimed in claim 14, wherein to snugly receive the fastener, said upper module part forms an upper hole, said lower module part forms a lower hole, and said metallic plate forms a middle hole, and all said upper hole, said lower hole and said middle hole are not concentric with one another but in an offset manner.

16. The electrical connector as claimed in claim 14, wherein the upward surface and said downward surface extend either horizontally or obliquely.

17. The electrical connector as claimed in claim 16, wherein the upper surface or the downward surface extends horizontally and forms a step.

18. The electrical connector as claimed in claim 17, wherein said step is formed in a corresponding hole in the corresponding one of the upper module part and the lower module part.

* * * * *